United States Patent [19]

Churas et al.

[11] 4,021,930

[45] May 10, 1977

[54] HAIR DRYER

[75] Inventors: Algerd C. Churas, Westchester; Robert T. MacLagan, Park Forest; William R. Hemrich, Glen Ellyn, all of Ill.

[73] Assignee: Sunbeam Corporation, Chicago, Ill.

[22] Filed: Jan. 13, 1976

[21] Appl. No.: 648,697

[52] U.S. Cl. ..... 34/99; 132/9

[51] Int. Cl.[2] ..... A45D 20/00

[58] Field of Search ..... 34/96–101; 219/372, 374; 132/7, 9

[56] References Cited

UNITED STATES PATENTS

| | | | |
|---|---|---|---|
| 2,023,883 | 12/1935 | Gross | 34/99 |
| 3,724,092 | 4/1973 | McCleerey | 34/99 |
| 3,727,322 | 4/1973 | Walter et al. | 34/99 |
| 3,769,718 | 11/1973 | Nopanen | 34/99 |

*Primary Examiner*—Kenneth W. Sprague
*Assistant Examiner*—James C. Yeung
*Attorney, Agent, or Firm*—George R. Clark; Neil M. Rose; Clifford A. Dean

[57] ABSTRACT

A portable hard hat type hair dryer having control means for directing heated air either to the front, back and sides of the head, to the back and sides of the head only, or to the back of the head only. This hair dryer is further characterized by a pin-and-slot hinge connection between the upper end of the tubular air conduit and the dome-shaped hood, by sliding latch means for releasably connecting the hood to the base, and by an improved air flow arrangement. Means may be provided in the base for introducing steam into the hood prior to a hair drying operation.

14 Claims, 11 Drawing Figures

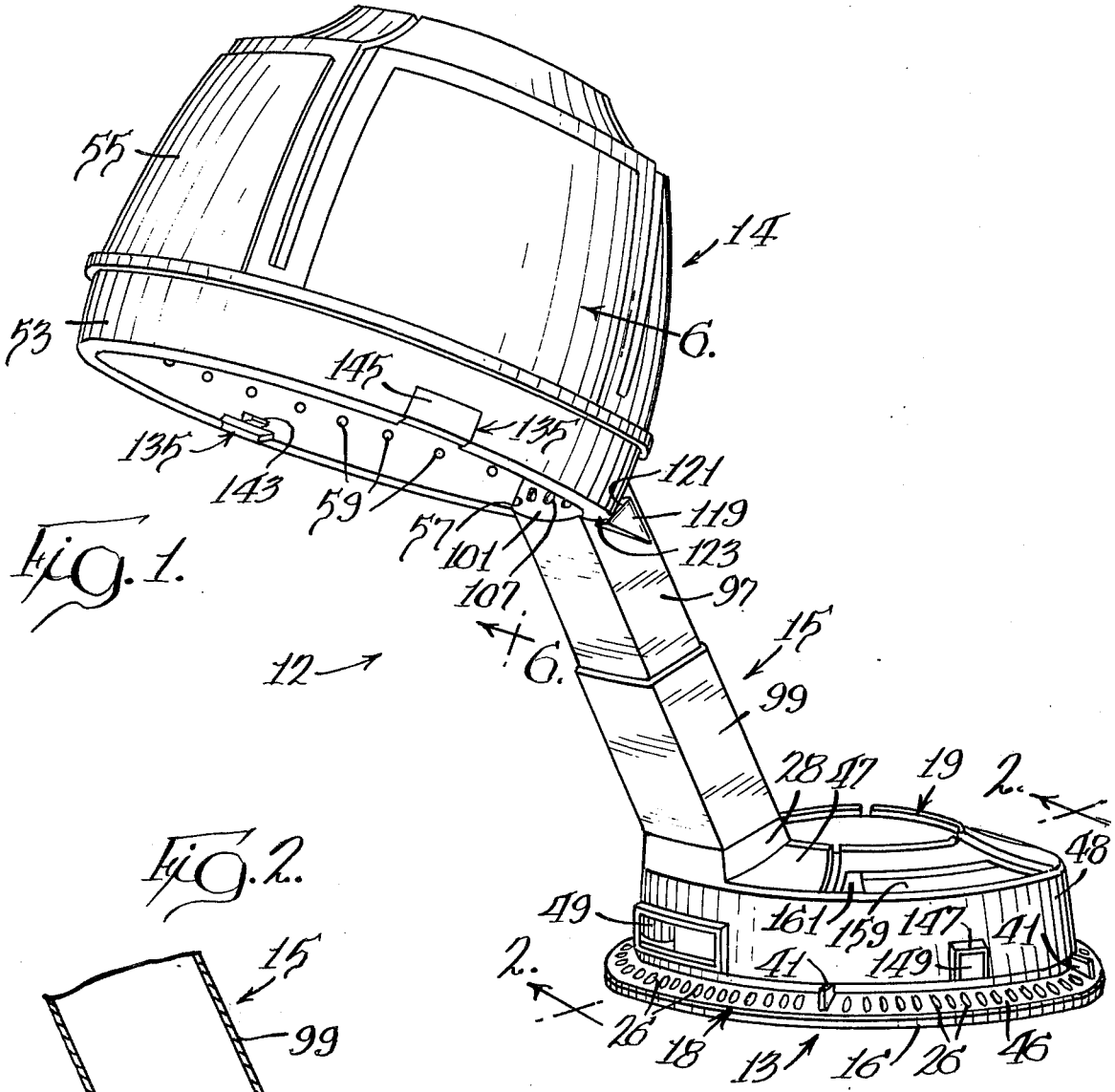
Fig. 1.
Fig. 2.
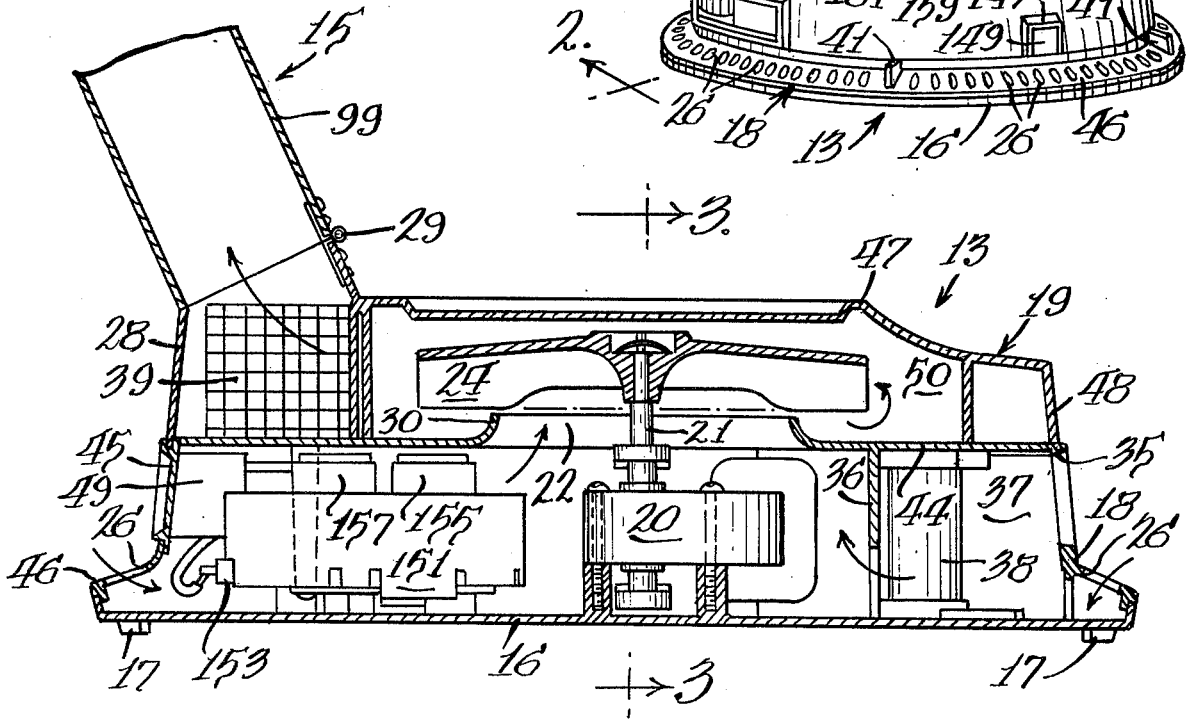

14
51
62
55
115
57
113
117
111
107
103
109
53
101
123
102
105
121
119
97

HAIR DRYER

BACKGROUND OF THE INVENTION

1. Field of the Invention.

The present invention pertains to a portable hard hat type hair dryer having directional air flow control means.

2. Description of the Prior Art

While portable hard hat type hair dryers having directional air flow control means may be known in the art, the prior art is not known to teach the particular air flow control means, the novel hood/air conduit pin-and-slot hinge means, or the hood/base slide latch means disclosed herein.

SUMMARY OF THE INVENTION

The present invention is concerned with a portable hard hat hair dryer having a control for directing a flow of heated air to various portions of a head of hair to be dried. Steam producing means may also be provided for introducing steam into the hair dryer hood prior to a hair drying operation. With the present hair styles, different portions of the head may require different drying times and techniques.

As will be described in greater detail herein, the present hair dryer comprises a base in which is provided a motor driven fan, air heating means, and, if desired, steam producing means, an air conduit pivotally mounted on the base, and a domed hood mounted on the upper end of the air conduit by a pin and slot hinge arrangement. The hood is characterized by four air chambers disposed circumferentially therearound and an air flow control for directing heated dry air or steam to various parts of the head through selection of different combinations of the four air chambers.

It is an object of the present invention to provide a new and novel portable hard hat hair dryer.

It is a further object of the present invention to provide such a hair dryer having an improved air flow arrangement.

It is a still further object of the invention to provide such a hair dryer having a novel slide latch arrangement for automatically latching the hood to the base for storing or carrying the hair dryer.

Another object of the present invention is to provide such a hair dryer having an improved air flow control structure in the hood to permit directing heated air either to the top and back of the head only, to the top, back and sides of the head only, or to the top, back, sides and front of the head.

Still another object of the present invention is to provide such a hair dryer having a novel pin and slot hinge connection of the hood to the upper end of the air conduit.

A still further object of the present invention is to provide such a hair dryer having means for selectively introducing steam to the hair dryer hood prior to a hair drying operation.

Further objects and advantages of the present invention will become apparent as the following description proceeds, and the features of novelty which characterize the invention will be pointed out with particularity in the claims annexed to and forming a part of this specification.

BRIEF DESCRIPTION OF THE DRAWINGS

For a better understanding of the present invention, reference may be had to the accompanying drawings in which:

FIG. 1 is a perspective view of a portable hard hat type hair dryer embodying the present invention in it opened-up operative position;

FIG. 2 is an enlarged vertical sectional view through the base and the lower end of the air conduit taken generally along line 2–2 of FIG. 1;

DESCRIPTION OF THE PREFERRED EMBODIMENT

Figure 3:
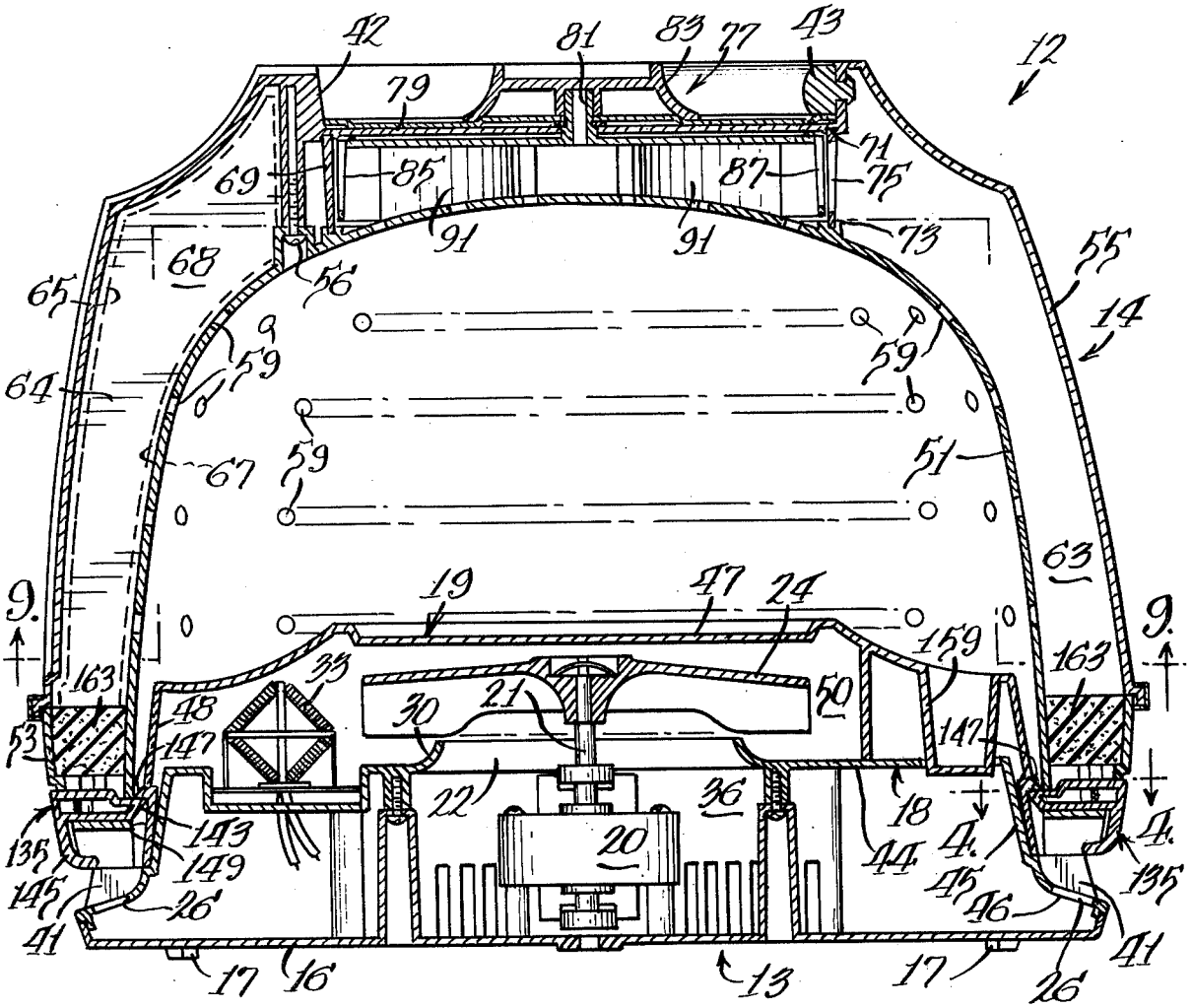
FIG. 3 is an enlarged vertical sectional view through the hair dryer when in its folded or collapsed carrying or storage position taken generally along line 3—3 of FIG. 2.

Referring now to the drawings in which like parts are designated by like numerals in the various views, there is shown in FIG. 1 a perspective view of the hair dryer, designated generally by reference numeral 12, which embodies the present invention. The hair dryer 12 of the present invention is a portable hard hat type hair dryer which is characterized by a base 13, a hood 14 and a tubular air conduit 15 which is hingedly connected at its upper end to the hood 14 and at its lower end to the base 13 whereby the hair dryer 12 may be folded from its operable position as shown in FIG. 1 into its storage or carrying position as shown in FIG. 3 in a manner well known in the art.

As best shown in FIGS. 2 and 3, the base 13 is comprised of a generally circular bottom plate 16 having a series of relatively small feet 17 provided hereon, a central base member 18 which is mounted on the bottom plate 16, and an upper base member 19 which is mounted on the central base member 18. The central base member is characterized by a generally circular top wall 44 having a depending skirt 45 which terminates in an outwardly and downwardly angled peripheral edge 46. The upper base member 19 is characterized by a generally circular top wall 47 and by a depending side wall 48. An electric motor 20 is suitably mounted on the bottom plate 16 with its drive shaft 21 disposed vertically and extending upwardly through a circular opening 22 formed in the top wall 44 of the central base member 18. A vane-type fan 24 is mounted on the upper end of the drive shaft 21 and is disposed above the motor 20 and in a space defined between the top walls 44 and 47 of the central and upper base members 18 and 19, respectively. The diameter of the fan 24 is somewhat larger than the diameter of the opening 22 through which the drive shaft 21 extends.

The downwardly angled peripheral edge 46 of the central base member 18 is provided with a series of air inlet openings 26 which extend completely around same. During operation of the motor driven fan 24, air is drawn inwardly through the air inlet openings 26 and upwardly through the opening 22 provided in the central base member 18 into an annular air chamber 50 defined between the top walls 44 and 47 of the central and upper base members 18 and 19, respectively, and by the side wall 48 of the upper base member 19. Although not clearly shown in the drawings, the air chamber 28 has a scroll-like configuration which terminates at an upwardly extending tubular neck portion 28 formed on the top wall 47 of the upper base member 19 and to which the lower end of the tubular air conduit 15 is hingedly connected by a hinge 29. The edge of the opening 22 in the top wall 44 of the central base member 18 is curved upwardly, as at 30, and a known type upwardly curved formation (not shown) is formed on the central base member 18 adjacent the upwardly projecting neck portion 28 whereby to aid in directing a flow of air upwardly through the neck portion 28 and the tubular air conduit 15. One or more heating elements 33 are provided on the central base member 18 in the path of air flow whereby to heat the flow of air directed through the tubular air conduit 15. A dial-type switch 49 having "Off," "Hi," "Med.," and "Lo" heat positions is connected in a circuit with the fan motor 20, the heating elements 33, and a power cord (not shown). The dial switch 49 is mounted on the central base member 18 for rotation about a vertical axis and is accessible for manipulation through aligned openings formed in the skirt 45 of the central base member 18 and in the side wall 48 of the upper base member 19.

In many known portable hard hat hair dryers, the fan is located beneath the motor and thus the air inlet parts are often located in the bottom plate. It is noted that the structural arrangement disclosed herein, with the fan disposed above the motor and with the air inlet ports disposed above the bottom plate of the hair dryer, results in an improved and highly efficient air flow through the hair dryer.

Diametrically opposite from the upwardly projecting neck 28, the central base member 18 is provided with a peripheral opening 35 and with an inwardly spaced vertical wall structure 36 which define a power cord storage area 37 (FIG. 2). Mounted between the bottom base plate 16 and the top wall 44 of the central base member 18 and in the corners of the cord storage area 37 are a pair of weight members 38 (FIG. 2) which serve to counter-balance the hair dryer 12 when same is unfolded into its operable position shown in FIG. 1. Also as shown in FIG. 2, the lower end of the neck portion 28 is provided with a screen 39 which serves to prevent fingers or other objects from coming into contact with the heating means 33. The downwardly angled peripheral edge 46 of the central base member 18 is provided with four circumferentially spaced abutments 41 which are adapted to support the hood 14 when the hair dryer 12 is folded into its storage or carrying position as shown in FIG. 3. Also, as best shown in FIG. 3, the top of the hood 14 is provided with an upwardly opening circular recess 42 and a carrying handle 43 has its ends received in openings formed in the side wall of the recess 42. When the handle 43 is not in use for carrying the hair dryer 12, the handle 43 may be pivoted downwardly into a generally horizontal position wholly within the recess 42.

Figure 9:
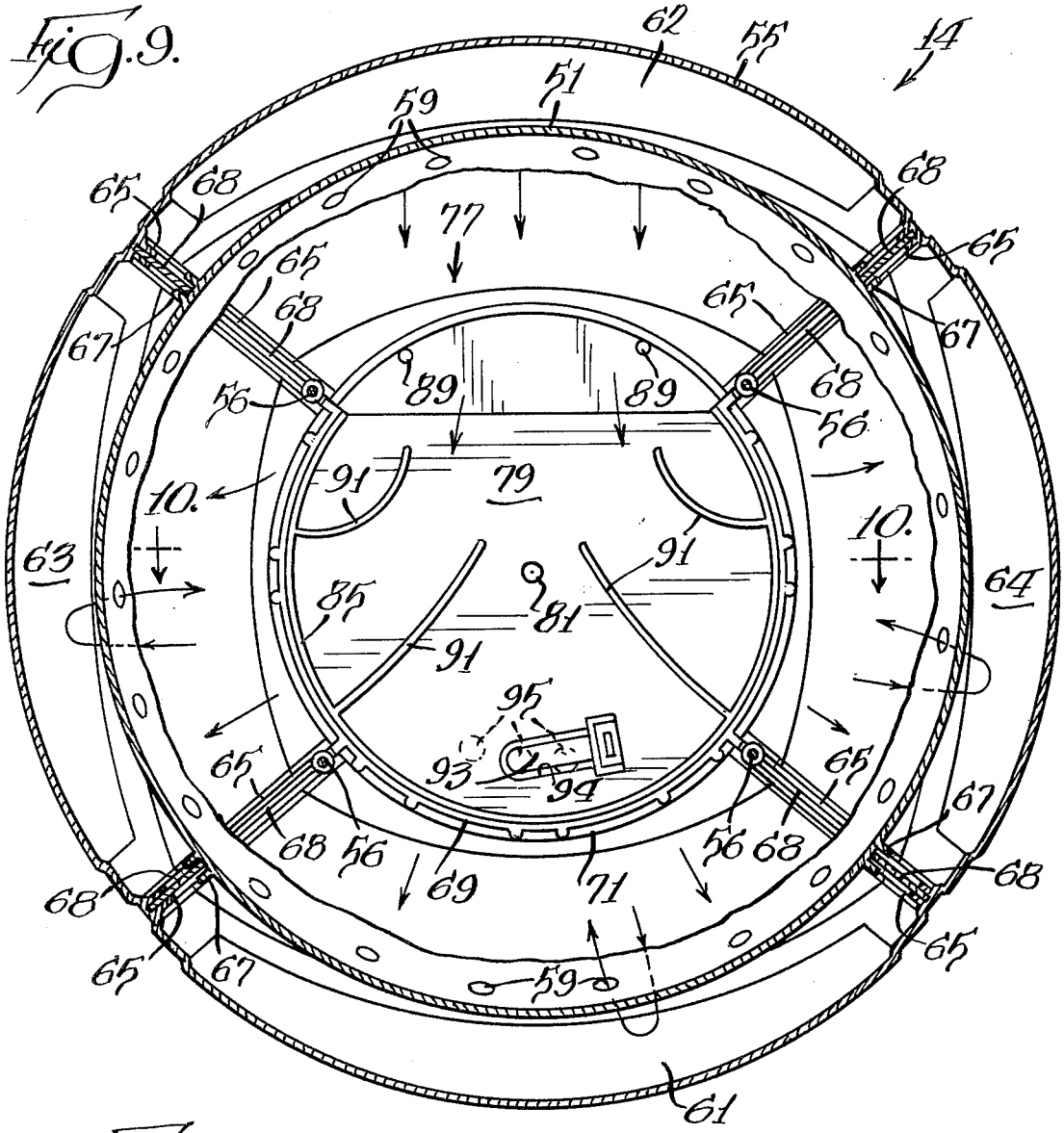
FIG. 9 is a horizontal sectional view taken generally along line 9—9 of FIG. 3.
Figure 11:
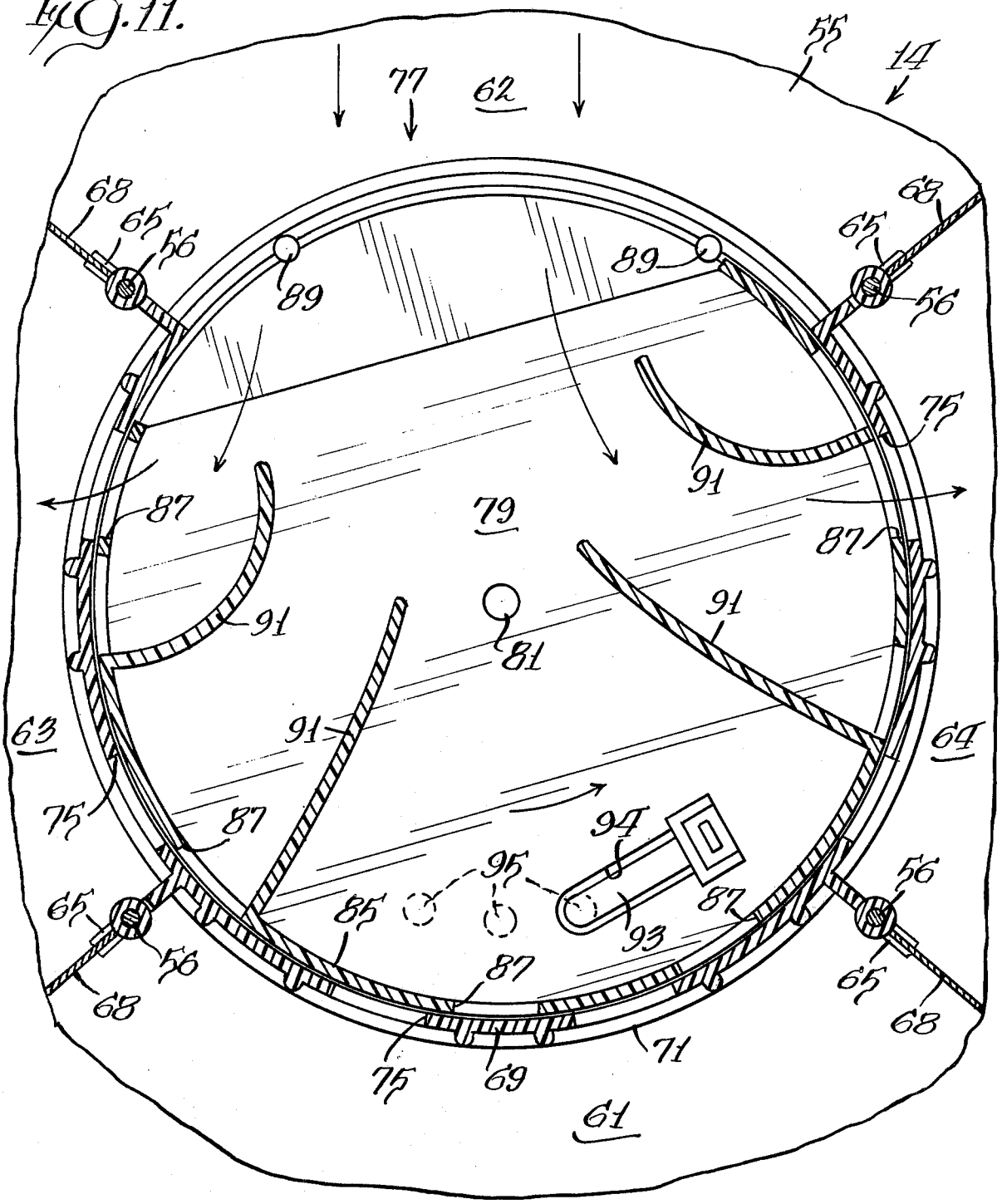
FIG. 11 is a horizontal sectional view taken generally along line 11—11 of FIG. 10.

The hood 14 is characterized by an inner perforated shell 51 having an outwardly and upwardly turned-up rim 53 and by an outer imperforate shell 55 which is supported on the upper edge of the turned-up rim of the inner shell 51 whereby an air chamber is defined between the inner and outer shells 51 and 55. The two shells 51 and 55 are secured together by four circumferentially disposed bolts 56, as shown in FIGS. 3, 9 and 11. The inner shell 51 is mounted on the upper end of the tubular air conduit 15 in a manner to be described hereinafter and the turned-up rim 53 is provided with a generally rectangular opening 57 which, in the operable position of the hair dryer as shown in FIG. 1, places the air chamber of the hood 14 in communication with the upper end of the tubular air conduit 15 whereby the heated air flowing upwardly therethrough is directed into the hood air chamber for distribution to the hair of a person using the dryer through the perforations or holes 59 formed in the inner hood shell 51.

However, the hood air chamber is partitioned off into four circumferentially spaced chambers or sectors including a front sector 61, a top and rear sector 62 and two side sectors 63 and 64. This partitioning is accomplished by providing a series of grooved ribs 65 and 67 which are provided on the inner surface of the outer shell 53 and on the outer surface of the inner shell 51, respectively, and by partitions 68 which have their opposite edges received in the grooved ribs 65 and 67.

A control valve means is provided for directing the flow of heated air to various ones of the four sectors 61, 62, 63 and 64. More specifically, the control valve means has three positions in the first of which the heated air is directed to the top and rear sector 62 only, a second position in which the heated air is directed to all four sectors 61, 62, 63 and 64, and a third position in which the heated air is directed to the top and rear sector 62 and to the two side sectors 63 and 64 only.

Figure 10:
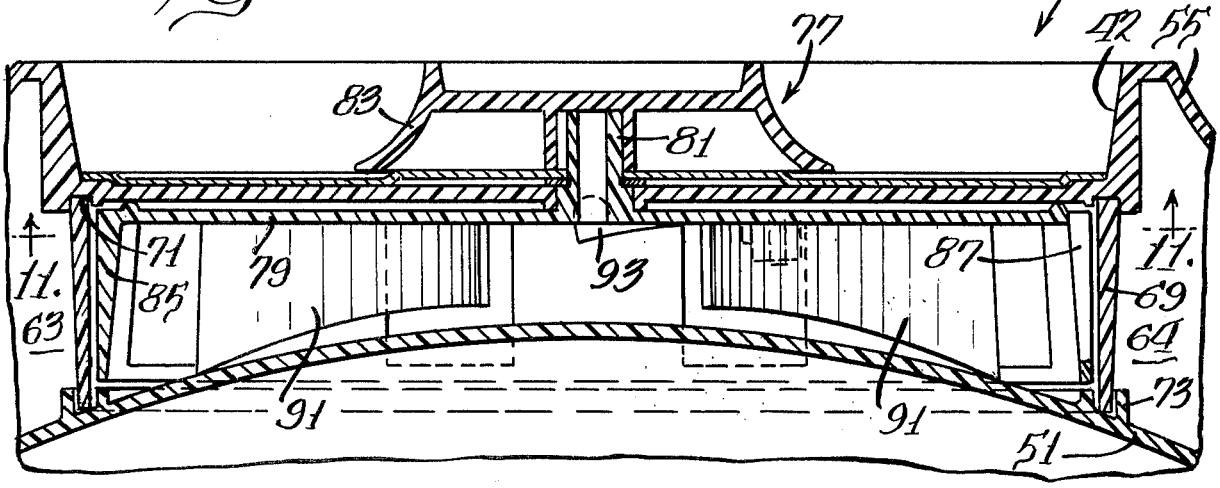
FIG. 10 is an enlarged vertical sectional view taken generally along line 10—10 of FIG. 9.

The air flow control valve means is characterized by a generally cylindrical fixed valve sleeve 69 and by a rotatable control valve 77. The valve sleeve 69 has its upper edge received in a circular grooved rib 71 formed on the underside of the top wall of the outer hood shell 55 and its lower edge received in a generally circular grooved rib 73, FIG. 10, formed on the top of the inner hood shell 51. As best shown in FIGS. 9 and 11, the sleeve 69 extends circumferentially only for the longer distance between the two partitions 68 defining the rear or back sector 62 whereby the top and back sector 62 is at all times in communication with the upper end of the tubular air conduit 15. However, the sleeve 69 is provided with a series of circumferentially spaced openings or windows 75 with at least two of said openings being provided at the upper ends of each of the front and side sectors 61, 63 and 64, respectively.

The control valve 77 is characterized by a generally circular flat plate portion 79 which is rotatably mounted against the underside of the top of the outer hood shell 55 by means of a stem 81 which projects upwardly through the top wall of the outer hood shell 55 and is rotatable therein. A control knob 83 is mounted on the upper end of the stem 81 and is disposed wholly within the upwardly opening recess 42 provided in the top of the hood 14. The flat plate portion 79 of the valve 77 has a sector removed which corresponds to the distance between the partitions 68 defining the back or rear sector 62. The circular edge portion of the flat plate portion 79 of the valve 77 is provided with a depending skirt 85 which is rotatable closely adjacent to the inner surface of the valve sleeve 69. The skirt 85 is also provided with a series of circumferentially spaced openings or windows 87 which, in different positions of the valve 77, are adpated to be either aligned or non-aligned with certain of the openings 75 in the valve sleeve 69, as is best illustrated in FIG. 11. Two stop members 89 are provided on the underside of the top wall of the outer hood shell 55 for limiting the rotary movement of the valve 77.

In FIG. 11, the control valve 77 is shown in its position, adjacent one of the stop members 89, for directing heated air both to the top and back sector 62 and to the two side sectors 63 and 64 through the aligned openings 75 and 87. When the valve 77 is rotated clockwise to its mid position, as shown in FIG. 9, all of the openings 75 and 87 are in alignment, as may be determined by an examination of FIG. 11, and heated air is directed to all four sectors 61, 62, 63 and 64. When the valve 77 is rotated still further in a clockwise direction to a position adjacent the other stop member 89 in FIG. 11, it will be noted that all of the sleeve windows 75 into the front and side sectors 61, 63 and 64 are blocked by the non-apertured portions of the valve skirt 85 whereby heated air is directed only to the top and back sector 62.

The underside of the flat plate portion 79 of the valve 77 is provided with a series of depending curved vanes 91 which aid in directing the heated air toward the various sectors in certain positions of the valve 77. A resilient detent 93 mounted on the flat plate portion 79 of the valve 77 is engageable, through a slot 94 provided in the plate portion 79, in one of three recesses 95 formed in the underside of the top wall of the outer hood shell 55 as an aid in positioning the valve 77 in each of its three positions.

The pin and slot hinge mounting of the hood 14 on the upper end of the tubular air conduit 15 is best shown in FIGS. 1, 6, 7 and 8. First, however, it is noted that the air conduit 15 is formed by two generally rectangular tubular members 97 and 99 with the upper conduit member 97 being telescopically received in the lower conduit member 99. The upper conduit member 97 may be telescopically adjusted relative to the lower member 99 by means of a known type spring detent arrangement, not shown in the drawings.

The upper ends of the front and rear walls of the upper air conduit member 97 are bent rearwardly at a slight angle as shown at 101 and 102, respectively, with the terminal end of the front wall 101 extending substantially beyond the terminal end of the rear wall 102 and with a pair of aligned substantially deep notches 103 being formed in the sidewalls the re-between. Strengthening ribs 105 are provided at the bend of the rear wall 102 and a series of openings 107 are provided in the angled front wall 101 whereby heated air is directed therethrough toward the hair covering the nape of a person's neck.

In providing the recess 57 in the inner hood shell 51 for reception of the upper end of the air conduit 15, the lower portion of the upturned rim 53 is open with only a relatively narrow upper edge portion 109 extending transversely across the recess 57. The recess 57 is further defined by a pair of vertically disposed sidewalls 111 which extend between the main body of the inner hood shell 51 and the up-turned rim 53 and which extend above the upper edge of the up-turned rim 53. The inner face of each sidewall 111 is characterized by an inwardly turned flange 113 and by a vertical slot 115 which is open at its upper end. For sliding and pivoting engagement in the slots 115, the outer ends of the sidewalls of the upper conduit member 97 are each provided with an outwardly projecting pin 117. The sidewalls of the upper conduit member 97 are also provided adjacent the angled bends therein with outward projections 119 having planar shoulders 121 defined thereon.

Figure 8:
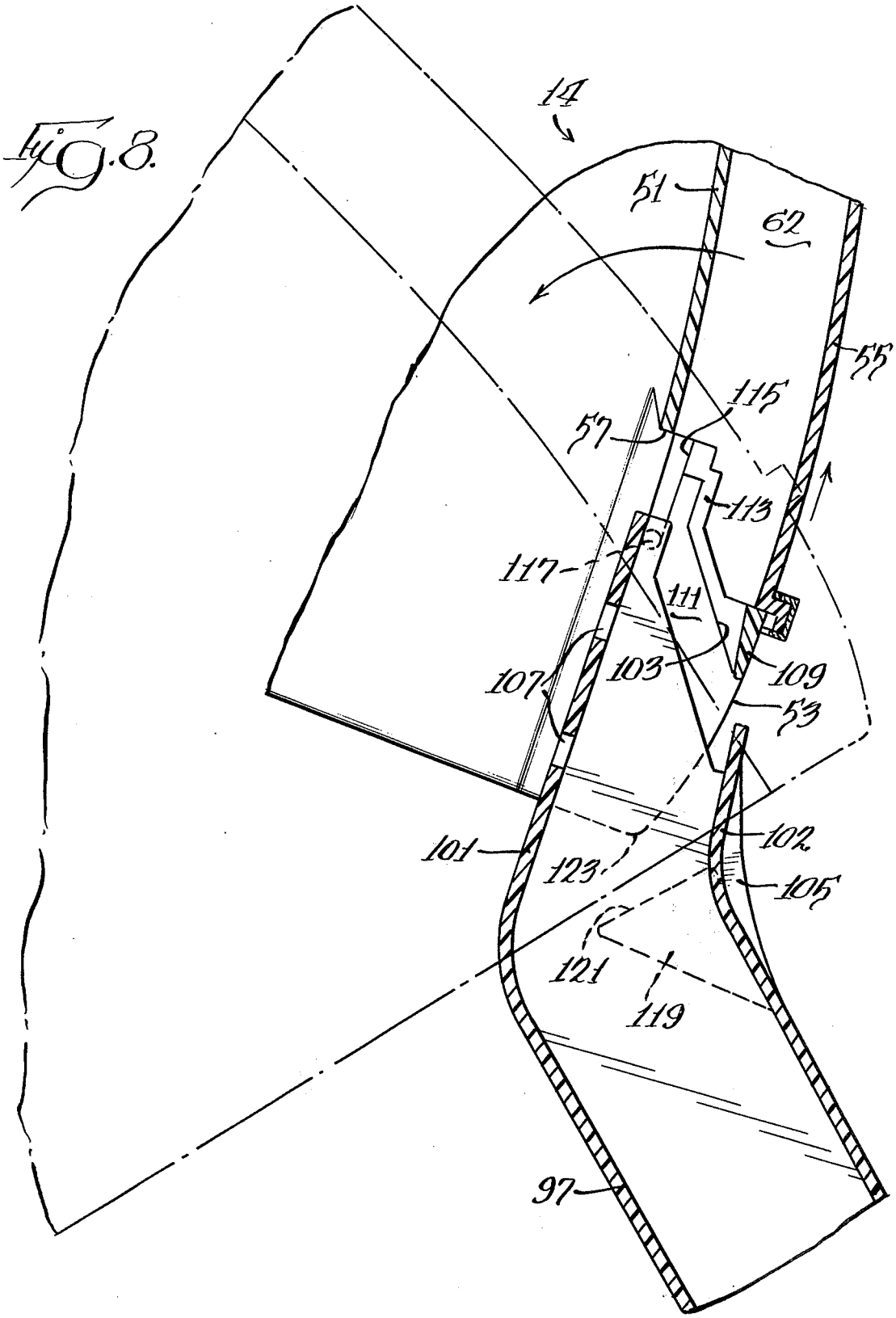
FIG. 8 is a further enlarged vertical sectional view of the hinge connection shown in FIG. 6 with the hood being shown in its uppermost position whereby same may be pivoted toward its folded storage or carrying position, as partially shown in broken line.

When the hood 14 is assembled to the upper end of the air conduit 15, the pins 117 are received in the slots 115 to provide a pin-and-slot hinge connection with the transverse edge portion 109 of the up-turned rim 53 being received in the notches 103 and with lower corners 123 of the up-turned rim 53 adjacent the recess 57 being engageable with the shoulders 121 defined on the projections 119 whereby to retain the hood 14 in an operable position at a desired angle to the air conduit 15. The angle of the hood 14 to the air conduit 15 may be adjusted by relative downward movement of the pins 117 in the slots 115 as a result of upward movement of the hood 14 relative to the air conduit 15. However, when it is desired to fold the hair dryer 12 from its operable position of FIG. 1 into its storage or carrying position of FIG. 3, the pins 117 are moved to the bottom of the slots 115 in which position the transverse edge portion 109 of the up-turned rim 53 is clear of the notches 103 and the lower corners 123 of the up-turned rim 53 are no longer engageable with the shoulders 121, as best shown in FIG. 8, whereby the hood 14 may be pivoted forwardly relative to the air conduit 15 in a manner well known in the art.

Figure 4:
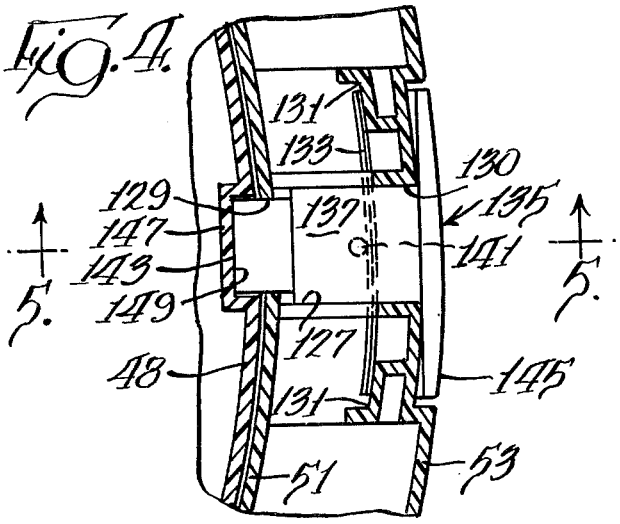
FIG. 4 is an enlarged horizontal sectional detail view of the slide latch for releasably latching the hood to the base.
Figure 5:
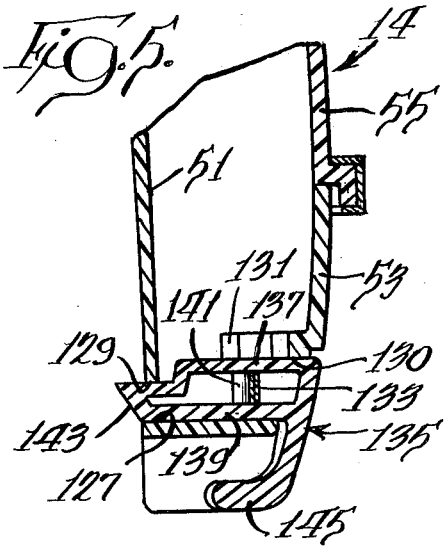
FIG. 5 is a vertical sectional view of the slide latch taken generally along line 5—5 of FIG. 4.
Figure 6:
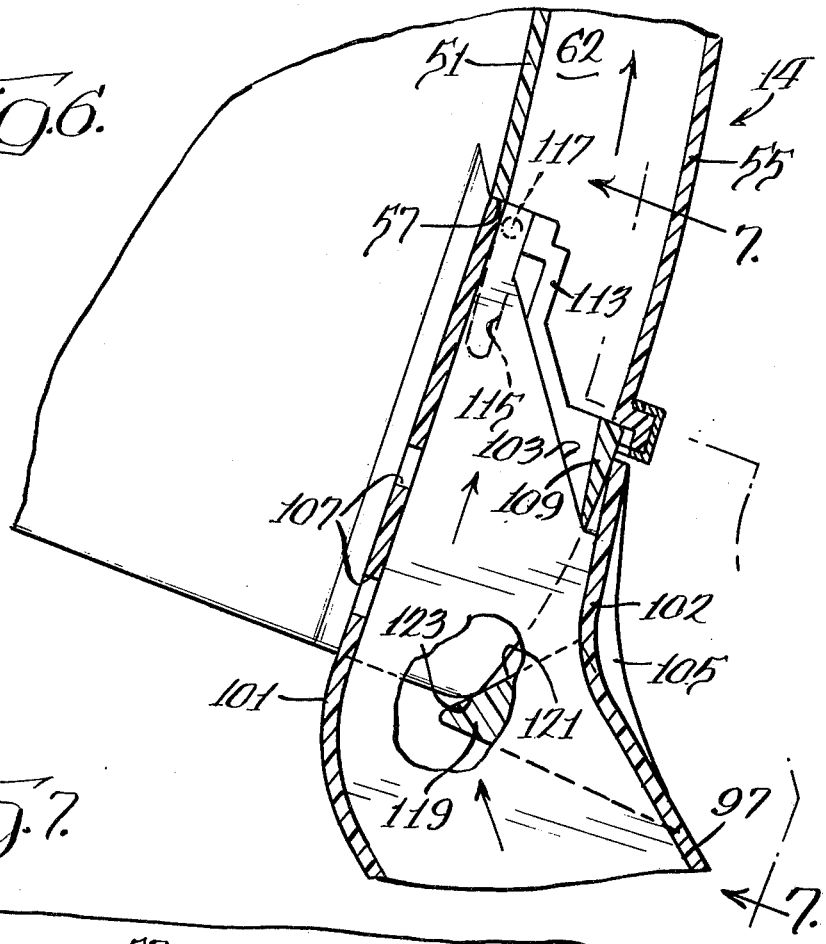
FIG. 6 is an enlarged vertical sectional view through the pin-and-slot hinge connection between the upper end of the tubular air conduit and the hood and taken generally along line 6—6 of FIG. 1.
Figure 7:
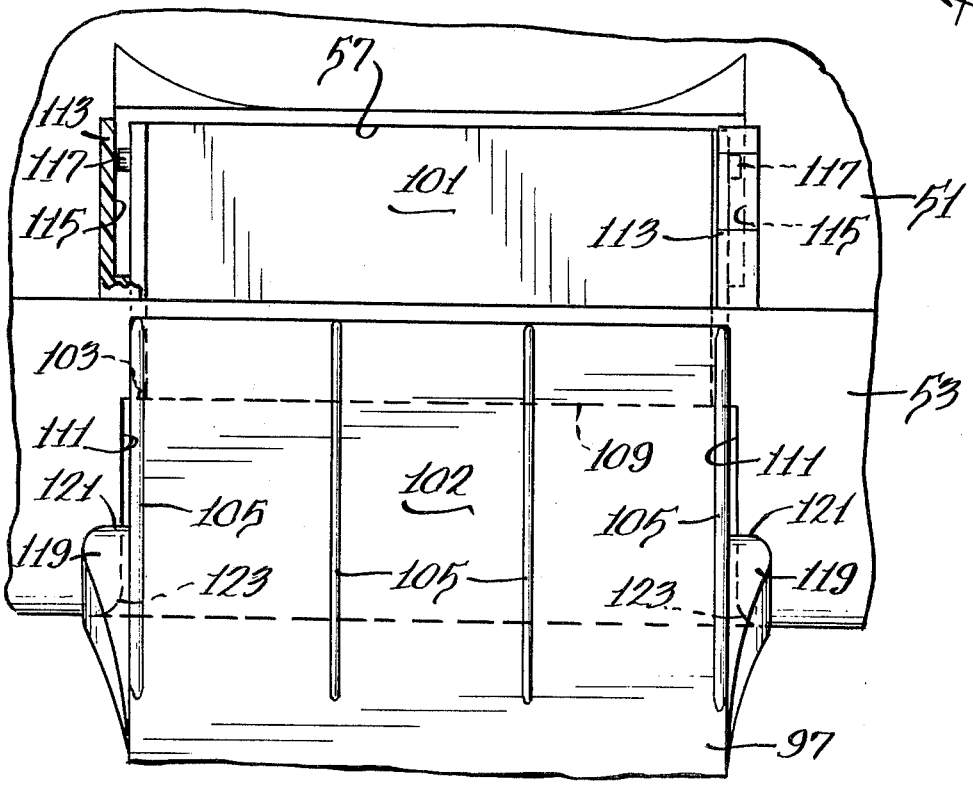
FIG. 7 is a rear elevational view, partially in vertical section, of the hinge connection shown in FIG. 6 taken generally along line 7—7 of FIG. 6.

As is best shown in FIGS. 3, 4 and 5, a slide latch arrangement is provided for automatically latching the hood 14 to the base 13 when the hood 14 is folded onto the base 13 for storage or carrying purposes. This latch arrangement is characterized by a pair of radially disposed slide track formations 127 which may be molded into the bottom of the up-turned rim 53 of the inner hood shell 51 in diametrically opposite locations thereon. At the opposite ends of each slide track formation 127, openings 129 and 130 are formed in the main portion of the inner hood shell 51 and in the up-turned rim 53 thereof respectively. Positioned on opposite sides of each slide track formation 127 is a retainer formation 131 for the ends of one or more strips 133 of spring metal.

A slide latch 135 for each slide track formation 127 is characterized by an upper wall 137, by a lower wall 139, by a vertical post 141 extending therebetween midway between the side edges thereof, by open sides, by an angled inner end 143 and by a depending inwardly turned finger-engaging portion 145 at its outer end, which latter portion 145 conforms generally to the configuration of the up-turned rim 153. The strip or strips 133 of spring metal extend transversely through each slide latch 135 between the upper and lower walls 137 and 139 thereof and outwardly of the vertical post 141 in a manner such that each slide latch 135 is biased inwardly whereby the angled inner end 143 of each latch 135 extends through the opening 129 in the main body portion of the inner hood shell 51 and into engagement with the underside of the upper edge 147 of a recess 149 formed on the outer surface of the depending side walls 48 of the upper base member 19. In a known manner, the upper surface of the upper edge 147 of each recess 149 may be angled downwardly whereby when engaged by the angled inner ends 143 of the latches 135, as the hood 14 is assembled downwardly onto the base 13, the slide latches 135 are forced outwardly against the resilience of the spring metal strips 133 to permit the latches 135 to be engaged in the recesses 149 whereby to automatically latch the hood 14 to the base 13.

The structure disclosed thus far herein defined a very efficient nonmist type portable hard hat hair dryer having a control for selectively directing heated air to various areas of the head. However, the preferred embodiment of the invention disclosed in the drawings is further directed to such a hair dryer wherein steam or "mist" may be selectively introduced into the hood 14 prior to a hair drying operation whereby to permit still different hair styling techniques. This steam producing structure will now be described with particular reference to FIGS. 1 and 2 of the drawings.

As shown in FIG. 2, a boiler 151 having a sheathed heating element 153 associated therewith is suitably supported from the underside of the top wall 44 of the central base member 18 and has both a water inlet 155 and a steam outlet 157 provided in its upper surface. The sheathed heating element 153 is connected to the dial-type switch 49 which also has a mist setting.

The top wall 47 of the upper base member 19 is provided with an open topped recess or water reservoir 159 (FIG. 1) having a discharge opening provided in its bottom at one end thereof, the discharge opening being aligned with the water inlet 155 to the boiler 151. The discharge opening from the reservoir 159 is normally resiliently closed by a known type valve which may be opened by a push-button 161 (FIG. 1) whereby to admit water to the boiler 151 when it is desired to introduce steam to the hood 14. The steam outlet 157 from the boiler 151 is in communication with a vertical bore (not shown) formed in the top wall 44 of the central base member 18 immediately below the tubular neck portion 28 of the top wall 47 of the upper base member 19 whereby the steam formed in the boiler 151 is effectively directed into the tubular air conduit 15 for transmission to one or more sectors 61, 62, 63 or 64 of the hood 14, depending upon the positioning of the control valve 77. To protect the slide latches 135, particularly the spring metal strips 133, from any moisture that might collect in the side sectors 63 and 64, sponge pads 163 (FIG. 3) may be provided to overlie the slide latches 135.

While there has been shown and described a preferred embodiment of the present invention, it will be apparent to those skilled in the art that various changes and modifications may be made without departing from the invention in its broader aspects and it is, therefore, comtemplated in the appended claims to cover all such changes and modifications that fall within the true spirit and scope of the present invention.

What is claimed as new and desired to be secured by Letters Patent of the United States is:

1. In a portable hard hat hair dryer of the type having a base, tubular air conduit means hingedly connected to the base, and a domed hood mounted on the upper end of the tubular air conduit means and having an air chamber formed therein, the improvement which comprises, air inlet means provided in the base, an electric motor, a fan driven by said motor for drawing air inwardly through said air inlet means and directing a flow of air upwardly through said air conduit means to said hood air chamber, heater means mounted in said base in the path of said air flow for heating same, means partitioning said hood air chamber into a plurality of sectors adapted for applying heated air to different parts of the head, said plurality of sectors including a circular top sector in communication with said tubular air conduit means and a series of circumferentially spaced, vertically extending sectors each of which is selectively adapted to have its upper end placed in communication with said top sector, a circular air flow control valve rotatable disposed within said top sector of said hood air chamber for directing heated air to various ones of said circumferentially spaced sectors, pin-and-slot hinge means for attaching said hood to the upper end of said tubular air conduit, and slide latch means for automatically latching said hood to said base for storage or carrying purposes.

2. The improved hair dryer of claim 1 wherein selectively operable steam producing means is provided in said base for introducing steam into said hood through said tubular air conduit means prior to a hair drying operation.

3. The improved hair dryer of claim 2 wherein said steam producing means comprises a boiler having a sheathed heating element associated therewith, a water reservoir, selectively operable valve means between said reservoir and said boiler for introducing water into said steam-producing boiler, and conduit means for directing steam produced in said boiler into said tubular air conduit means.

4. The improved hair dryer of claim 1 wherein said base comprises a bottom plate, a central base member mounted on said bottom plate and having a top wall, a depending skirt, and a downwardly and outwardly angled peripheral edge, and an upper base member mounted on said central base member and having a top wall and a depending side wall, an air chamber defined by said top walls of said central and upper base members and by said upper base member sidewall, an air inlet to said air chamber defined by an opening formed in said top wall of said central base member, an air outlet from said chamber defind by an opening formed in said top wall of said upper base member and in communication with said tubular air conduit means, and a multiplicity of air inlet ports formed in said downwardly and outwardly angled peripheral edge of said central base member.

5. The improved hair dryer of claim 4 wherein said motor is mounted on said bottom plate with its drive shaft disposed vertically and extending upwardly through said air inlet opening in said top wall of said central base member and into said air chamber, and wherein said fan is mounted on the upper end of said drive shaft and within said air chamber, whereby, during operation of said fan motor, air is drawn into said air inlet ports and through said air inlet opening into said air chamber and is then directed into said tubular air conduit means through said air outlet from said air chamber.

6. The improved hair dryer of claim 1 wherein said hood comprises an inner perforate shell and an outer imperforate shell spaced therefrom with said hood air chamber being defined therebetween, wherein a series of circumferentially spaced vertically extending partitions are provided between said inner and outer shells defining a front sector, two side sectors, and a combined top and rear sector, and wherein the upper ends of said front and side sectors are defined by a generally cylindrical valve sleeve extending between the underside of the top of said outer shell and the top of said inner shell, said top and rear sector being in communication at all times with the upper end of said tubular air conduit means.

7. The improved hair dryer of claim 6 wherein said generally cylindrical valve sleeve is provided with a series of circumferentially spaced openings with at least one opening being provided at the upper end of each of said side sectors and at the upper end of said front sector, and wherein said rotatable air flow control valve comprises a flat plate rotatable against the underside of the top of said outer hood shell, a stem projecting upwardly through the top wall of said outer shell and being rotatable therein, and a valve skirt depending from the periphery of said flat plate and being rotatable closely adjacent to the inner surface of said generally cylindrical vlave sleeve, said valve skirt being provided with a series of circumferentially spaced openings adapted to be aligned and/or non-aligned with various combinations of said openings in said generally cylindrical valve sleeve depending upon the rotational position of said valve skirt.

8. The improved hair dryer of claim 7 wherein a pair of spaced stop members are provided on said upper hood shell for limiting the rotational movement of said control valve, wherein a control knob is provided on the upper end of said valve stem for rotating said control valve between three positions defined between said pair of stop members, and wherein a threeposition spring detent means is provided between said control valve and said outer hood shell, said valve skirt in a first position of said valve blocking off all of said openings in said generally cylindrical valve sleeve whereby only said combined top and rear sector is in communication with said tubular air conduit means, said valve skirt in a second position of said valve blocking off all of said openings in said valve sleeve leading to said front sector whereby only said side sectors and said combined top and rear sector are in communication with said tubular air conduit means, and said openings in said valve skirt in a third position of said valve being all aligned with the valve sleeve openings for said front and side sectors whereby all four sectors are in communication with said tubular air conduit means.

9. The improved hair dryer of claim 1 wherein said slide latch means comprises a pair of diametrically opposite radially extending openings formed in the lower portion of said hood, a radially extending slide track formation provided in said hood for each of said openings and aligned with the lower edges thereof, a slide latch supported on each of said slide track formations and having an angled latching surface provided on the inner end thereof and a finger engageable portion formed on the outer end thereof, recess means provided on the outer surface of said base in radial alignment with each of said slide latches, and resilient means in said hood engageable with each of said slide lataches in a manner normally biasing said slide latches inwardly into latching engagement with said base recesses, said latches being releasable by outward movement thereof against the bias of said resilient means through the application of outward forces to said finger engageable portions thereof.

10. The improved hair dryer of claim 1 wherein the lower edge of said hood is provided with a radially extending opening having side walls and adapted to receive the upper end of said tubular air conduit, wherein said pin-and-slot hinge means comprises a pair of generally vertically extending open-topped slots formed is said side walls of said hood opening, and a pair of pins projecting outwardly from the sides of said tubular air conduit adjacent the upper end thereof and received in said slots for pivoting and relative vertical movement therein, wherein a pair of projections are provided one on either side of said tubular air conduit, said projections being provided with generally planar shoulders which are engageable by the lower corners of said hood defined by said opening therein whereby to support said hood in an operable position relative to said tubular air conduit, the angle at which said hood is supported relative to said tubular air conduit being adjustable by vertically adjusting said pins in said slots.

11. The improved hair dryer of claim 10 wherein the upper edges of the sides of said tubular air conduit are each further provided with an opentopped v-shaped notch adapted to adjustably receive an edge of said hood defined by said opening, said edge being defined at the top of said opening and being adjustable vertically in said notches as a further aid in supporting said hood in a desired angular position relative to said tubular air conduit.

12. In a portable hard hat hair dryer of the type having a base with top and bottom walls and a side wall, a tubular air conduit hingedly connected to the top wall of the base, and a domed hood mounted on the upper end of the tubular air conduit and having an air chamber formed therein, the improvement which comprises, a plurality of air inlet ports provided in the side wall of said base, an electric motor mounted on the bottom wall of said base, a fan disposed above and driven by said motor for drawing air inwardly through said air inlet ports and directing a flow of air upwardly through said air conduit to said hood air chamber, heater means mounted in said base in the path of said air flow for heating same, means partitioning said hood air chamber into a combined top and rear sector, a front sector, and a pair of side sectors for applying heated air to different parts of the head, a rotatable air flow control valve in said hood for directing heated air to various combinations of said sectors, said valve having a first position in which heated air is directed only to said combined top and rear sector, a second position in which heated air is directed only to said combined top and rear sector and to said pair of side sectors, and a third position in which heated air is directed to all four sectors, pin-and-slot hinge means for attaching said hood to the upper end of said tubular air conduit, means associated with said pin-and-slot hinge means for adjustably supporting said hood at different angles to said tubular air conduit, and a pair of biased slide latches for automatically latching said hood to said base for storage or carrying purposes.

13. The improved hair dryer of claim 12 wherein steam producing means is provided in said base for introducing steam into selected sectors of said hood through said tubular air conduit prior to a hair drying operation.

14. The improved hair dryer of claim 13 wherein said steam producing means comprises a boiler having a sheathed heating element associated therewith, a water reservoir formed in said top wall of said base, selectively operable valve means between said reservoir and said boiler for introducing water into said steam-producing boiler, and conduit means for directing steam produced in said boiler into said tubular air conduit.

* * * * *